US011045703B2

(12) United States Patent
Martino

(10) Patent No.: US 11,045,703 B2
(45) Date of Patent: Jun. 29, 2021

(54) RETRACTABLE SPORTS GOAL

(71) Applicant: Kyle Hunter Martino, Weston, CT (US)

(72) Inventor: Kyle Hunter Martino, Weston, CT (US)

( * ) Notice: Subject to any disclaimer, the term of this patent is extended or adjusted under 35 U.S.C. 154(b) by 0 days.

(21) Appl. No.: 16/237,404

(22) Filed: Dec. 31, 2018

(65) Prior Publication Data

US 2020/0206593 A1 Jul. 2, 2020

(51) Int. Cl.
*A63B 63/00* (2006.01)

(52) U.S. Cl.
CPC ..... *A63B 63/004* (2013.01); *A63B 2063/002* (2013.01); *A63B 2210/58* (2013.01)

(58) Field of Classification Search
CPC ..... A63B 63/00
See application file for complete search history.

(56) References Cited

U.S. PATENT DOCUMENTS 1,504,166 A * 8/1924 Thornley ..... A63B 63/083 473/481
2,884,252 A 10/1957 Thompson
3,427,026 A * 2/1969 Mahoney ..... A63B 69/0097 473/435
3,887,181 A 6/1975 Samaras
3,981,501 A 9/1976 Gonzalez et al.
4,421,318 A * 12/1983 Sverdlik ..... A63B 69/0097 473/476
4,718,674 A * 1/1988 Henry ..... A63B 69/3667 473/218
5,098,092 A * 3/1992 Aakre ..... A63B 63/083 473/483
5,102,128 A * 4/1992 Geise ..... A63B 63/083 473/483
5,186,469 A * 2/1993 Terris ..... A63B 63/004 473/478
5,273,292 A * 12/1993 Pardi ..... A63B 63/004 138/173
5,308,082 A 5/1994 Bigelow
5,413,356 A 5/1995 Bigelow
(Continued)

FOREIGN PATENT DOCUMENTS

JP 2000176065 6/2000
WO WO2013144069 10/2013

OTHER PUBLICATIONS

Young, Lee; PCT Search Report and Written Opinion; dated Jun. 11, 2020; pp. 11; Alexandria, Virginia.

*Primary Examiner* — Eugene L Kim
*Assistant Examiner* — Christopher Glenn

(57) ABSTRACT

A retractable sports goal includes a base housing and a goal frame. The housing includes first and second post sections and a crossbar section. The goal frame includes first and second goal posts and a crossbar. The bottom ends of the goal posts are in contact with the post sections during movement of the goal frame between a retracted position and a playing position. In the retracted position the goal frame is disposed in the housing with the goal posts and the crossbar respectively disposed adjacent the first and second post sections and the crossbar section, in the playing position the goal frame is disposed vertically with the bottom ends of the goal posts respectively disposed adjacent front ends of the first and second post sections.

10 Claims, 12 Drawing Sheets

(56) References Cited

U.S. PATENT DOCUMENTS

| | | | | |
|---|---|---|---|---|
| 5,839,980 | A | 11/1998 | Kendy | |
| 5,857,928 | A * | 1/1999 | Stewart | A63B 71/0054 473/446 |
| 6,432,002 | B1 | 8/2002 | Pavonetti | |
| 6,672,980 | B1 * | 1/2004 | Walsh | A63B 63/004 473/471 |
| 7,351,168 | B1 | 4/2008 | Pannell | |
| 7,371,195 | B2 * | 5/2008 | Stevens | A63B 63/004 273/127 R |
| 8,292,300 | B2 * | 10/2012 | Moore, III | A63B 63/004 273/400 |
| 8,784,229 | B1 * | 7/2014 | McCullough | A63B 69/3667 473/257 |
| 8,801,549 | B2 | 8/2014 | Leoni | |
| 2002/0193189 | A1 * | 12/2002 | Goldwitz | A63B 63/004 473/478 |
| 2004/0116215 | A1 * | 6/2004 | Fobean | A63B 63/004 473/478 |
| 2006/0202426 | A1 * | 9/2006 | Tennett, Sr. | A63B 63/00 273/407 |
| 2007/0191148 | A1 * | 8/2007 | Shannon | A63B 63/083 473/476 |
| 2011/0275461 | A1 * | 11/2011 | Pastore | B60B 33/0005 473/478 |
| 2016/0167688 | A1 * | 6/2016 | Jones | B62B 3/16 280/651 |

* cited by examiner

RETRACTABLE SPORTS GOAL

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to sports goals. More particularly, the present disclosure relates to a retractable sports goal.

2. Related Art

A variety of sports games require a rectangular playing surface and a pair of sports goals. Sports playing fields, such as for soccer, field hockey, lacrosse and other sports are large in size and require considerable grass field space and related maintenance. Many facilities, such as schools and community centers, have limited funds and/or space. This is particularly the case in lower income urban localities where both funding and sports playing fields are scarce commodities. In such localities, often the only open space dedicated for outdoor sports is an asphalt or concrete basketball court.

The popularity of soccer is increasing in this country, including by youngsters to an ever-increasing degree. Soccer is an outdoor activity that may be enjoyed by players having a wide variety of skill sets and ages. Further, games such as soccer have minimal equipment requirements, other than a playing surface, soccer goals and a soccer ball. Soccer goals include a horizontal crossbar supported by a pair of goal posts, and a structural frame extending rearward from the bottom of the goal posts and providing a counter-balance to the cross-bar and goal posts, and an attached net. When not in use, soccer goals require a large storage space, preferably in a dry space to mitigate against rust and weathering, as well as to protect against vandalism. These goals must then be relocated from their storage locations to the appropriate positions upon the playing surface to be used.

Other soccer goal arrangements include collapsible soccer goals which are much smaller and lighter than their official versions as generally described above. As such by their nature, these arrangements are flimsy in comparison. Collapsible soccer goals may include a plurality of telescoping poles connected endwise to form a rectangular goal opening, support poles extending rearward from the top corners of the goal to the ground or playing surface, and an attached net. Some arrangements may include poles which are hingedly attached that enable to the goal to be unfolded to a deployed position. These collapsible soccer goals have the advantage of being readily deployable on a variety of available playing surfaces. Grass spikes (to the extent the playing surface permits) and/or physical weights, such as sand bags, may be used in an attempt to keep these goals in place during play.

In view of the foregoing, there is a need in the art for an improved sports goal.

BRIEF SUMMARY

In accordance with one embodiment, there is provided a retractable sports goal that includes a horizontally disposed base housing and a goal frame. The base housing includes first and second post sections. Each of the first and second post sections has a front end, a back end and a post section body disposed between the front and back ends. The base housing further includes a crossbar section having first and second ends. The first and second ends are respectively connected to the front ends of the first and second post sections with the crossbar section being disposed perpendicular to the first and second post sections. The goal frame includes first and second goal posts. Each of the first and second goal posts has a top end, a bottom end and a post body disposed between the top and bottom ends. The goal frame further includes a crossbar having first and second crossbar ends. The first and second crossbar ends are respectively connected to the top ends of the first and second goal posts with the crossbar being disposed perpendicular to the first and second goal posts. The bottom ends of the first and second goal posts are respectively in contact with the first and second post sections during movement of the goal frame between a retracted position and a playing position. In the retracted position the goal frame is disposed in the base housing with the first and second goal posts and the crossbar respectively disposed adjacent the first and second post sections and the crossbar section. In the playing position the goal frame is disposed vertically with the bottom ends of the first and second goal posts respectively disposed adjacent the front ends of the first and second post sections.

According to various embodiments, the base housing may further include a main cover plate positionable along the crossbar section of the base housing. The main cover plate and the crossbar section are cooperatively sized and configured to surround the crossbar with the goal frame in the retracted position. The main cover plate may be hingedly attached to the crossbar section. The main cover plate may include first and second end flaps and a plate body extending between the first and second end flaps. The first and second end flaps are foldable upon the plate body and extendable to be parallel to the plate body. The main cover plate may be disposable between the bottom ends of the first and second goal posts with the goal frame in the playing position and the first and second end flaps being folded, and the main cover plate may be disposable upon the base housing with the goal frame in the retracted position and first and second end flaps being extended.

The sports goal may further include first and second support bars. The first support bar may be attached to the first goal post and the first post section, and the second support bar may be attached to the second goal post and the second post section. The first and second support bars have a stored length and an extended length. The first and second support bars respectively have the stored length upon the goal frame being disposed in the retracted position, and the first and second support bars respectively have the extended length upon the goal frame being disposed in the playing position. The first and second support bars are respectively selectively lockable in the extended length upon the goal frame being disposed in the playing position. The first and second support bars may be formed of telescoping sections.

The sports goal may further include first and second rails respectively disposed in the first and second goal post sections and respectively in contact with the first and second goal posts during movement of the goal frame between a retracted position and a playing position. The sports goal may further include first and second U-shaped support members respectively attached to the bottom ends. Each of the first and second U-shaped support members may have a cavity sized and configured to respectively receive the first and second rails therein. The first and second U-shaped support member may respectively include rollers attached therein in the cavity of each of the U-shaped support members for engaging the first and second rails in rolling contact during movement of the goal frame between a retracted position and a playing position. The sports goal may further include a net attachable to the goal frame.

According to another embodiment, there is provided a method of installing a sports goal for use in a playing surface having a basketball court with a basketball hoop extending from a backboard toward the basketball court. The method includes providing a sports goal that includes a horizontally disposed base housing and a goal frame. The base housing includes first and second post sections. Each of the first and second post sections has a front end, a back end and a post section body disposed between the front and back ends. The base housing further includes a crossbar section having first and second ends. The first and second ends are respectively connected to the front ends of the first and second post sections with the crossbar section being disposed perpendicular to the first and second post sections. The goal frame includes first and second goal posts. Each of the first and second goal posts has a top end, a bottom end and a post body disposed between the top and bottom ends. The goal frame further includes a crossbar having first and second crossbar ends. The first and second crossbar ends are respectively connected to the top ends of the first and second goal posts with the crossbar being disposed perpendicular to the first and second goal posts. The bottom ends of the first and second goal posts are respectively in contact with the first and second post sections during movement of the goal frame between a retracted position and a playing position. In the retracted position the goal frame is disposed in the base housing with the first and second goal posts and the crossbar respectively disposed adjacent the first and second post sections and the crossbar section. In the playing position the goal frame is disposed vertically with the bottom ends of the first and second goal posts respectively disposed adjacent the front ends of the first and second post sections. The method further includes positioning the base housing in the playing surface with the crossbar section being parallel to the backboard along the basketball court.

According to various embodiments, the base housing may be positioned such that it does not extend above the playing surface. The method may further includes providing a main cover plate positionable along the crossbar section of the base housing with the main cover plate and the crossbar section being cooperatively sized and configured to surround the crossbar with the goal frame in the retracted position. The method may further include aligning the main cover plate with the playing surface with the main cover plate positioned along the crossbar section and the main cover plate and the crossbar section surrounding the crossbar with the goal frame in the retracted position. The method may further include attaching a net to the goal frame. A pole may extend from the playing surface which supports the backboard. The method may further include positioning the cross bar section between the pole and the basketball court. The positioning of the base housing in the playing surface may include positioning the back ends of the base housing with the pole disposed between the back ends and the basketball court. The positioning of the base housing in the playing surface may include positioning the first and second post sections with the pole disposed there between.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
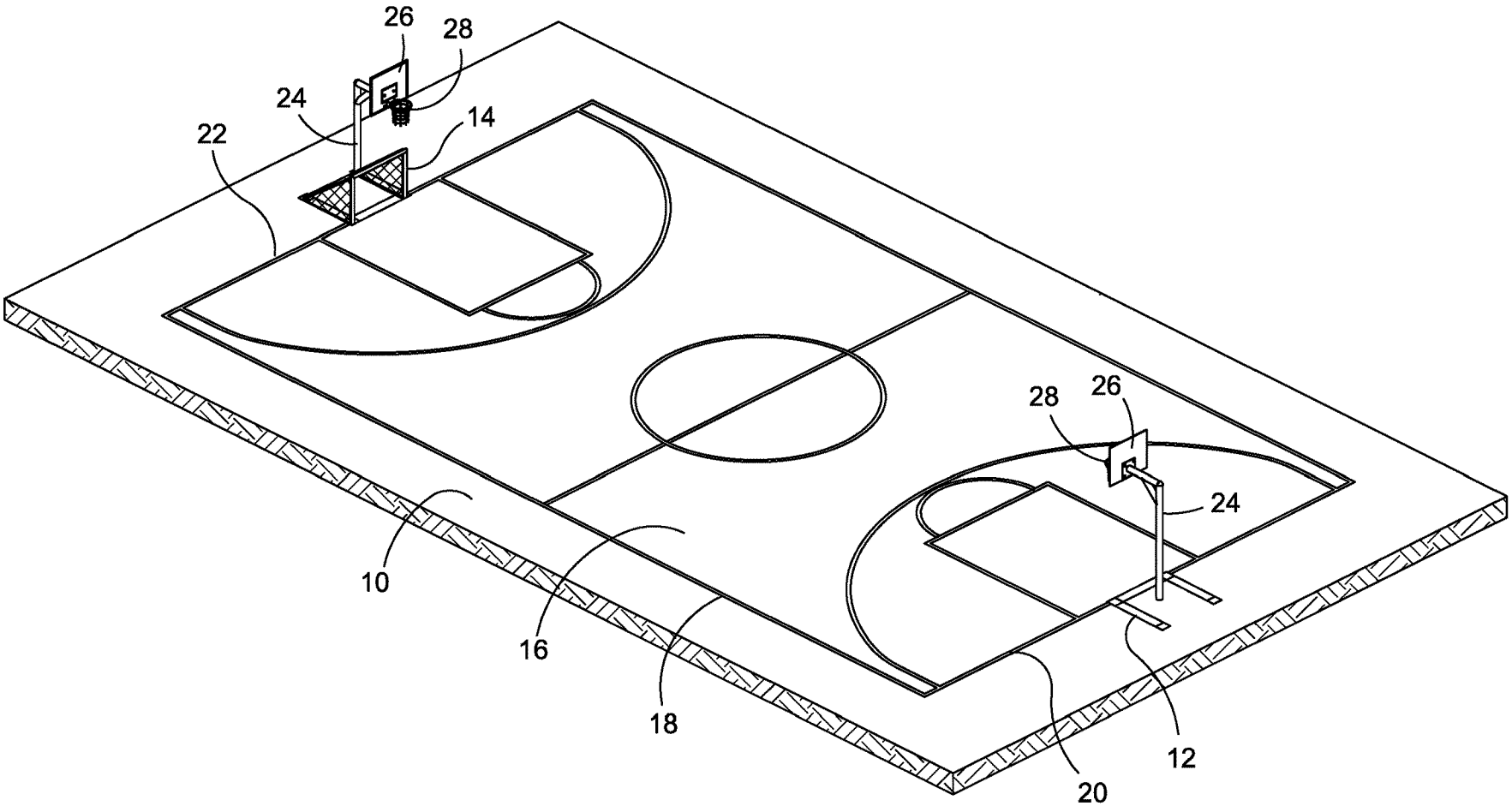
FIG. 1 is a perspective view of a playing surface including a basketball court and a pair of retractable sports goals as installed in the playing surface according to an aspect of the invention.

Referring now to FIG. 1 there is depicted a perspective view of a playing surface 10 with a pair of retractable sports goals 12, 14 as installed in the playing surface 10 according to an aspect of the invention. In this example, the playing surface 10 includes a basketball court 16 as defined by a court boundary 18. The court boundary 18 includes a first baseline 20 and a second baseline 22. At each of the first and second baselines 20, 22, a pole 24 supports a basketball backboard 26 with an attached basketball hoop 28. Each basketball backboard 26 is respectively aligned with the first and second baselines 20, 22. The retractable sport goal 12 is depicted in a retracted position and the retractable sports goal 14 is depicted in a playing position. The sports goals 12, 14 are installed in the playing surface 10 as aligned with the first and second baselines 20, 22 and basketball backboards 26. In this regard, the present invention recognizes that the sports goals 12, 14 may be installed relative to the court boundary 18 to allow the court boundary 18 to facilitate use in other games than basketball, such as a hardtop version of soccer, street hockey (with or without roller or inline skates, and street lacrosse. This installation allows for what otherwise would be a dedicated basketball activity space to a multi-use facilitate, allowing for the introduction of a variety activities.

With reference to FIGS. 2-15, in accordance with one embodiment, there is provided a retractable sports goal, such as the sports goal 12, that includes a horizontally disposed base housing 30 and a goal frame 32. The base housing 30 includes first and second post sections 34, 36. Each of the first and second post sections 34, 36 has a front end 38, a back end 40 and a post section body 40 disposed between the front and back ends 38, 40. The base housing 30 further includes a crossbar section 44 having first and second ends 46, 48. The first and second ends 46, 48 are respectively connected to the front ends 38 of the first and second post sections 34, 36 with the crossbar section 44 being disposed perpendicular to the first and second post sections 34, 36. The goal frame 32 includes first and second goal posts 50, 52. Each of the first and second goal posts 50, 52 has a top end 54, a bottom end 56 and a post body 58 disposed between the top and bottom ends 54, 56. The goal frame 32 further includes a crossbar 60 having first and second ends 62, 64. The first and second crossbar ends 62, 64 are respectively connected to the top ends 54 of the first and second goal posts 50, 52 with the crossbar 60 being disposed perpendicular to the first and second goal posts 50, 52. The bottom ends 56 of the first and second goal posts 50, 52 are respectively in contact with the first and second post sections 34, 36 during movement of the goal frame 32 between the retracted position and the playing position. With particular reference to FIGS. 2-5 and 9, in the retracted position the goal frame 32 is disposed in the base housing 30 with the first and second goal posts 50, 52 and the crossbar 60 respectively disposed adjacent the first and second post sections 34, 36 and the crossbar section 44. With particular reference to FIGS. 8 and 12-14, in the playing position the goal frame 32 is disposed vertically with the bottom ends 56 of the first and second goal posts 50, 52 respectively disposed adjacent the front ends 38 of the first and second post sections 34, 36. The sports goal 12 may further include a net 66 attachable to the goal frame 32. The net 66 may have various attachment points to various components of the goal frame 32. With the goal frame 32 in the retracted position the net 66 may be partially attached such as along the crossbar 60 and rolled or folded for storage in the base housing 30, such as depicted in FIG. 4.

The present invention is particularly suited to be installed in locations such as the basketball court 16 where there is an immovable object extends from the playing surface 10, such as the poles 24. The sports goal 12 may be installed in the playing surface 10 and because the crossbar section 44 of the base housing 30 is configured where the crossbar 60 is vertically aligned while the goal frame 32 is in both the retracted and playing positions, the crossbar 60 is not required to be rearward (where movement of the goal frame 32 between the retracted and playing positions may be restricted or interfered with). Further, it is contemplated that because the first and second post sections 34, 36 extend rearward from the crossbar section 44, the first and second post section 34, 36 may even extend past an immovable object (such as the pole 24).

Figure 2:
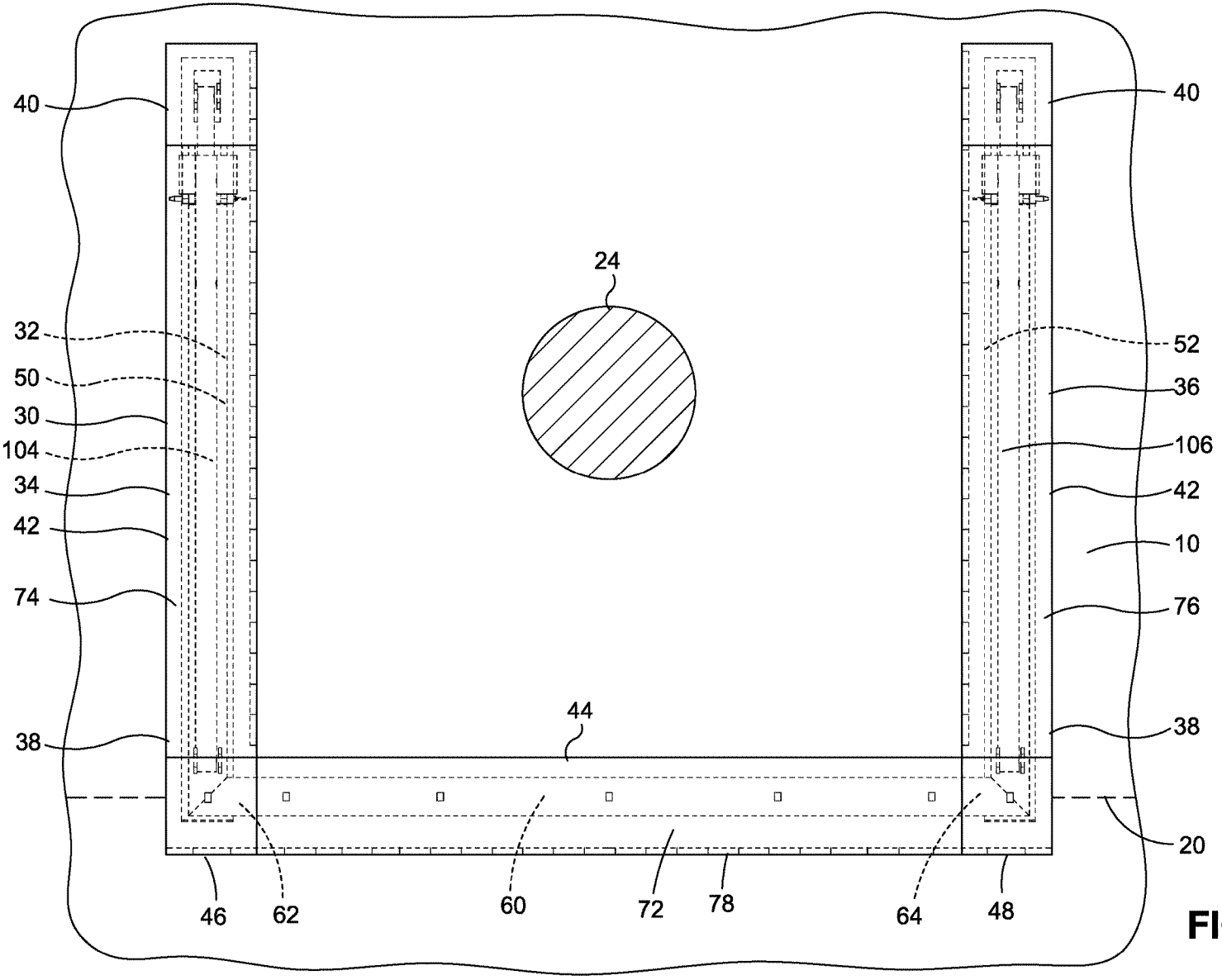
FIG. 2 is an enlarged top view of a sports goal of FIG. 1 in a retracted position in shown with a pole of a basketball backboard and a basketball hoop (with some components of the sports goal depicted in dashed-lining indicating that such components are position under other components and would otherwise be out of view)
Figure 3:
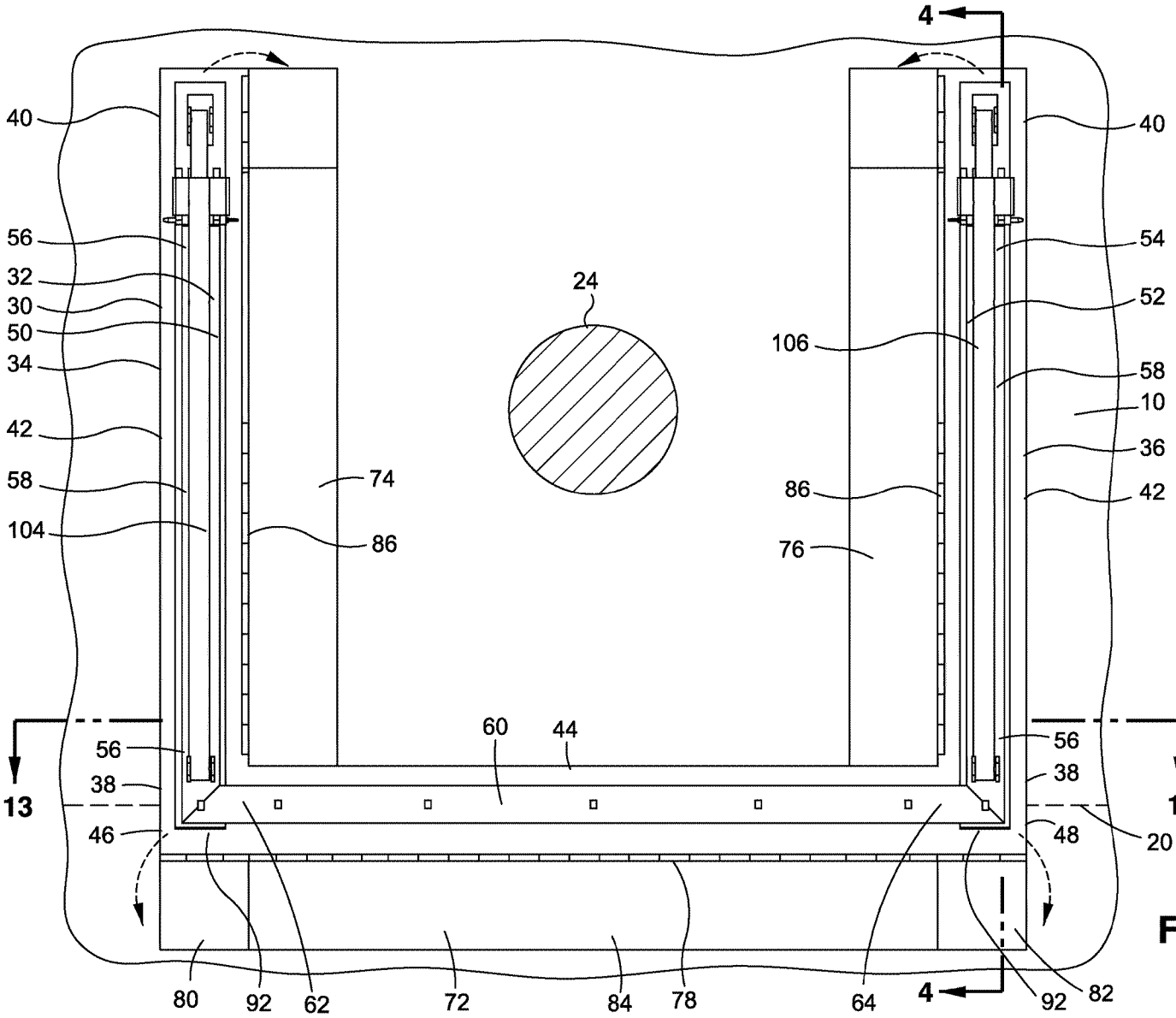
FIG. 3 is the enlarged top view of the sports goal of FIG. 2 with a main cover plate and side plates in an open position.
Figure 5:
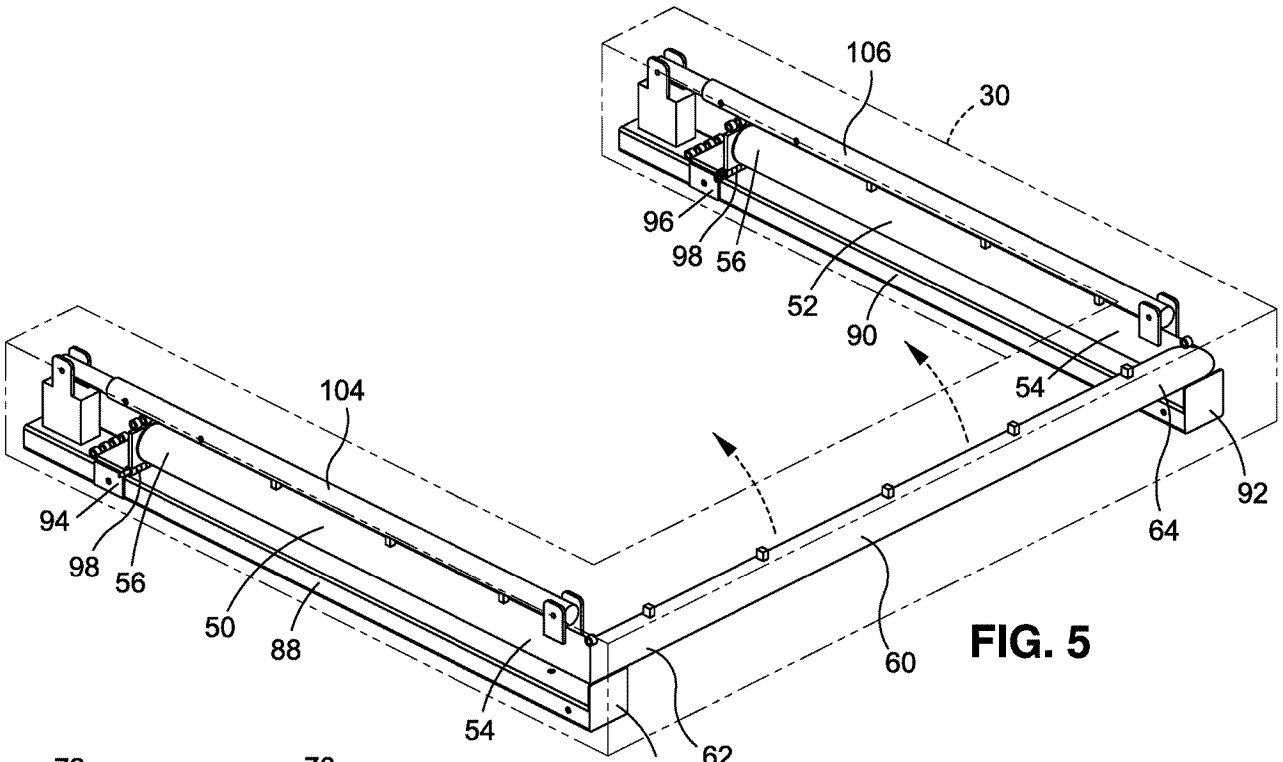
FIG. 5 is a perspective view of the sport goal with an outline of a base housing depicted in dashed-lining.
Figure 4:
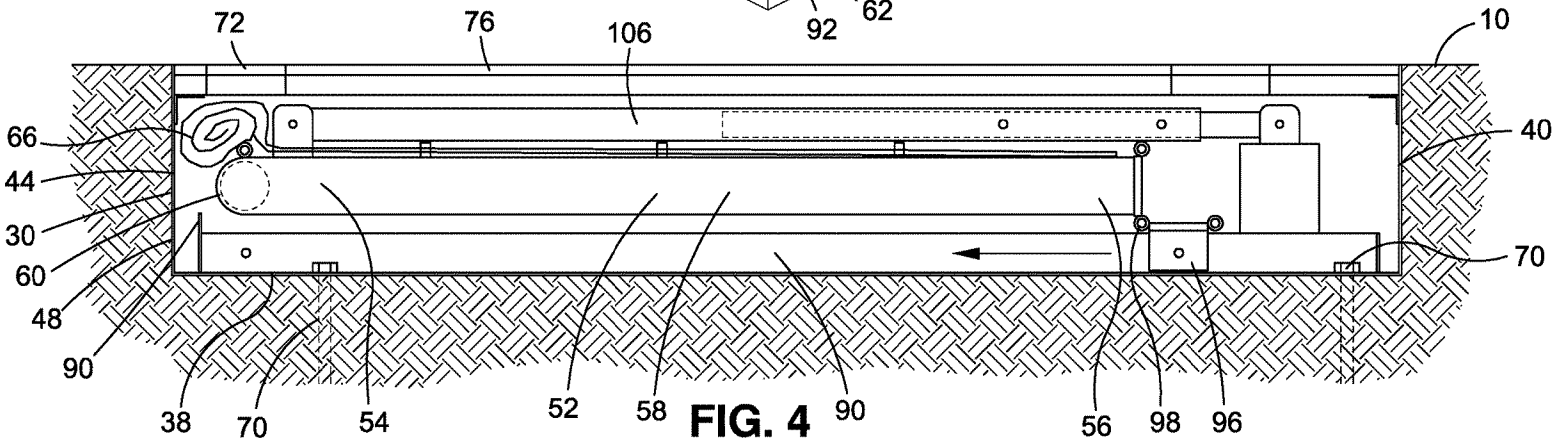
FIG. 4 is cross-sectional side view of the sports goal of FIG. 3 as depicted along axis 4-4.
Figure 6:
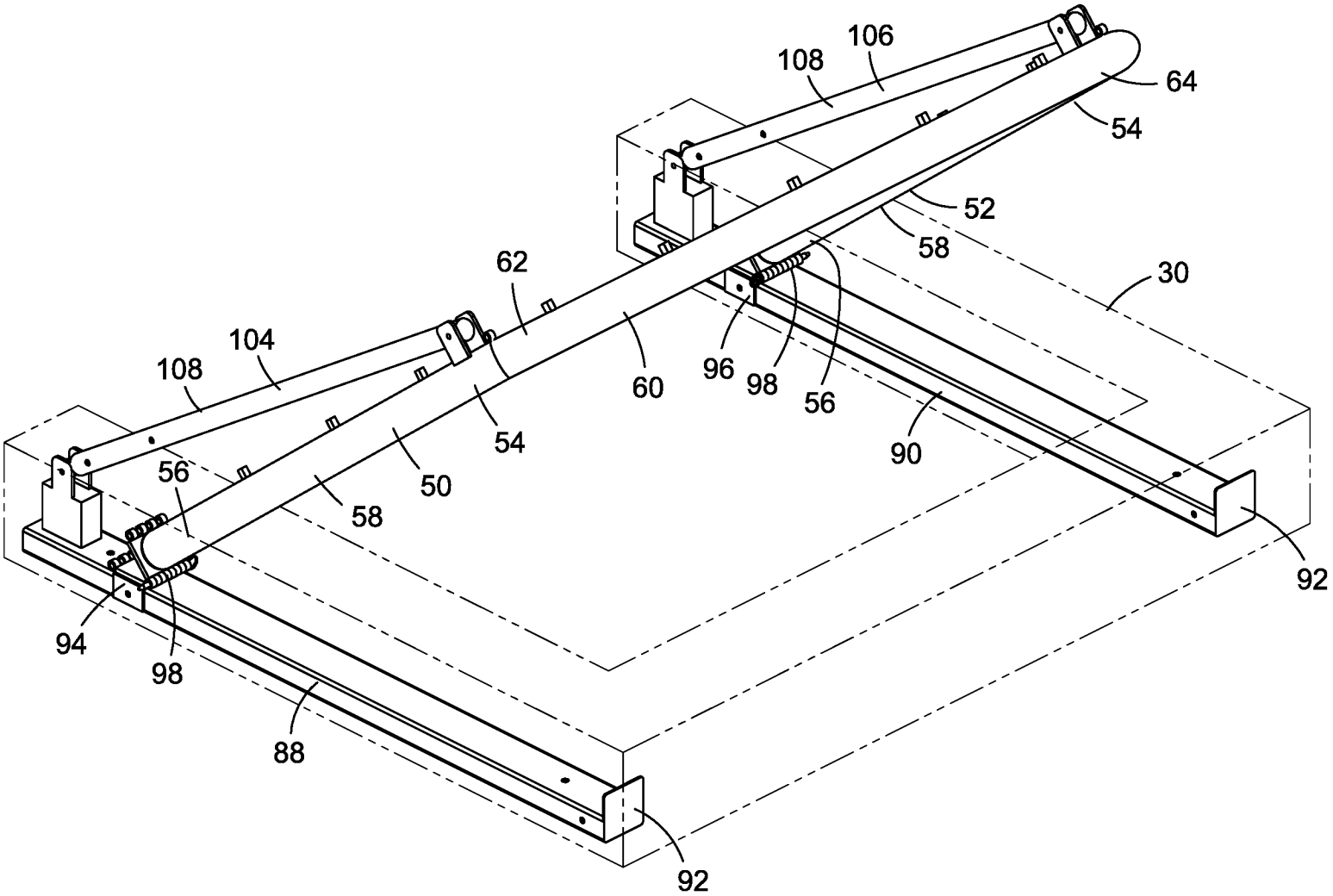
FIG. 6 is the perspective view of the sports goal of FIG. 5 with the goal frame in an intermediate position between the retracted position and a playing position.
Figure 7:
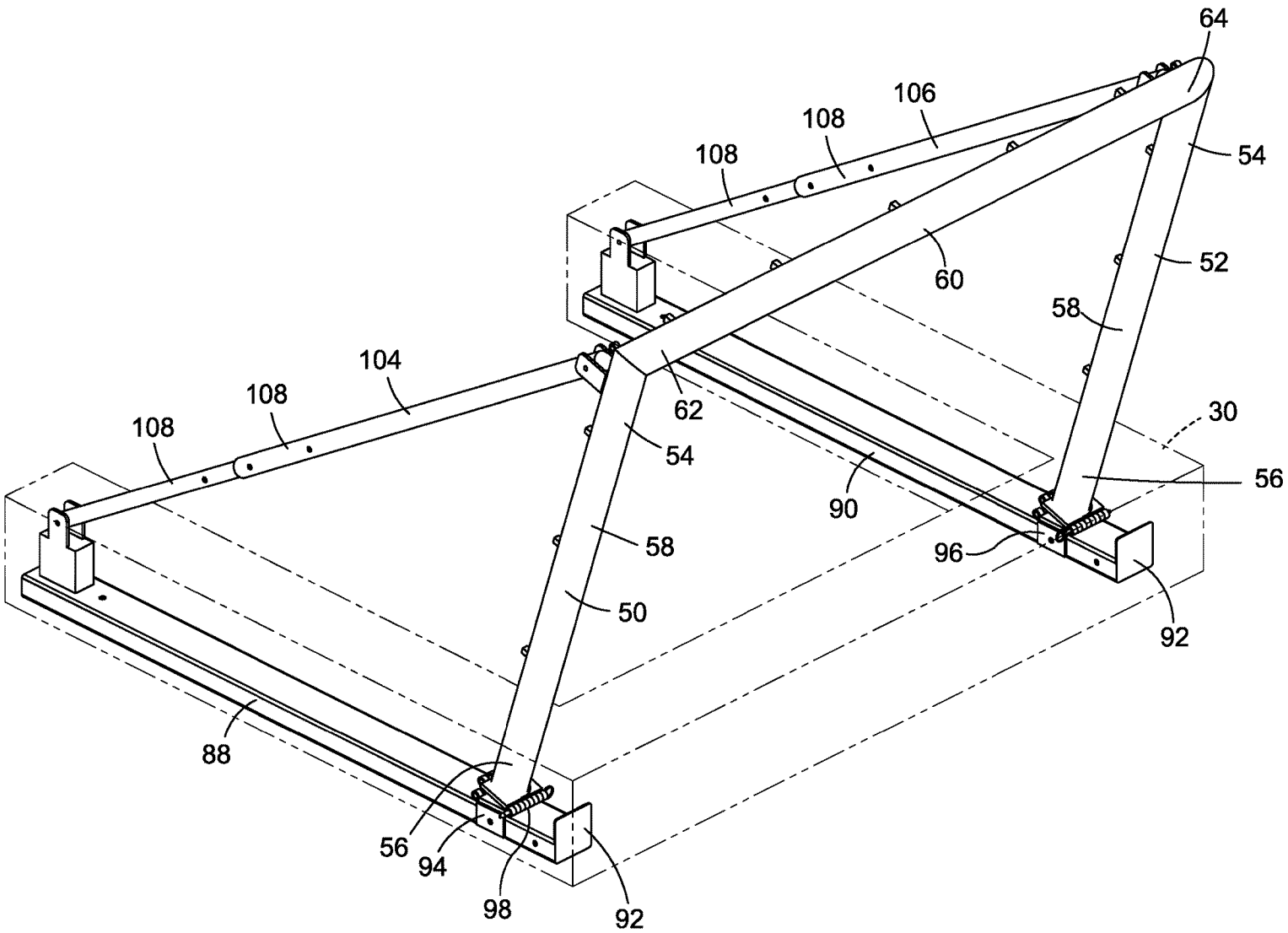
FIG. 7 is the perspective view of the sports goal of FIG. 6 with the goal frame in another intermediate position.
Figure 8:
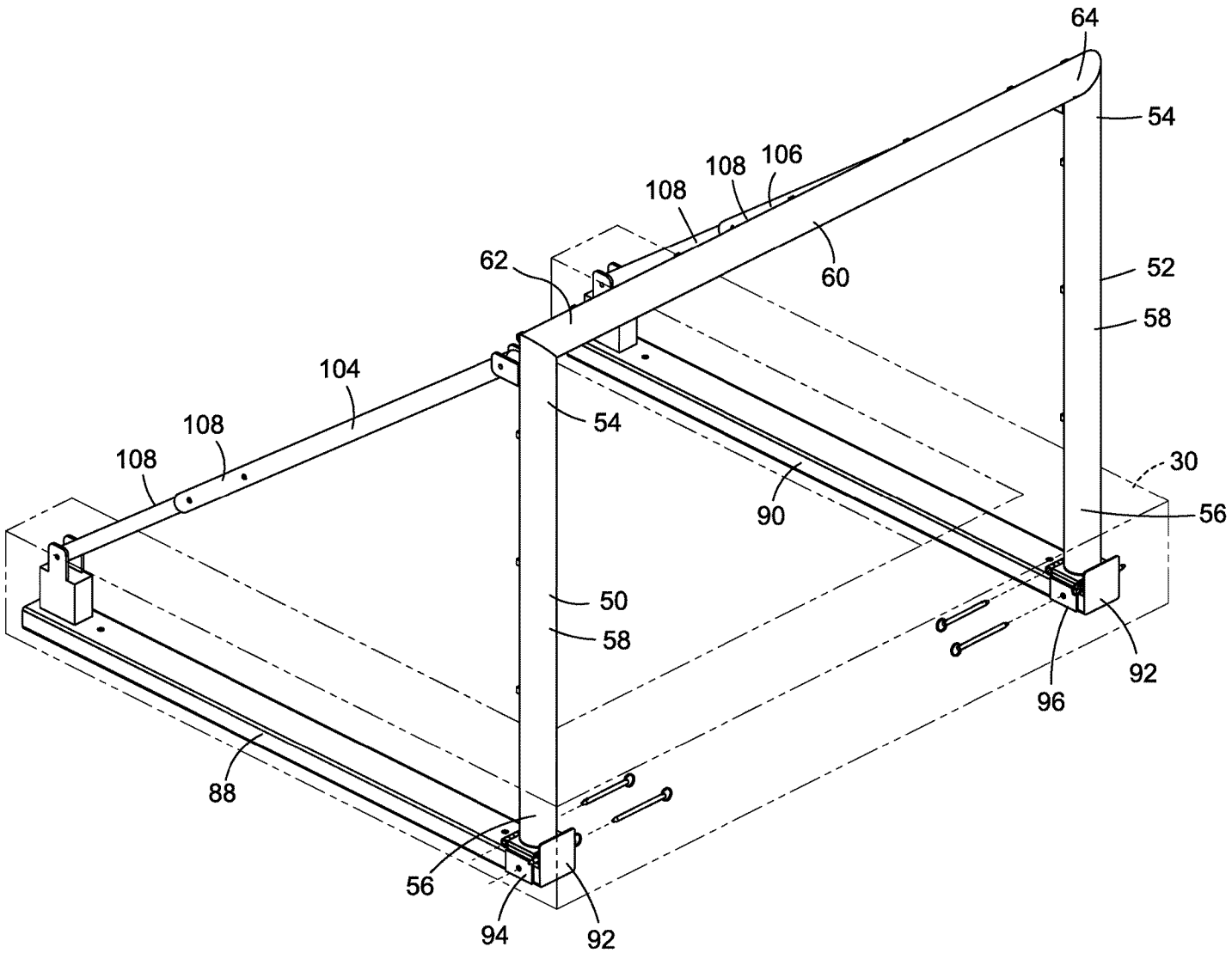
FIG. 8 is the perspective view of the sports goal of FIG. 7 with the goal frame in the playing position.
Figure 10:
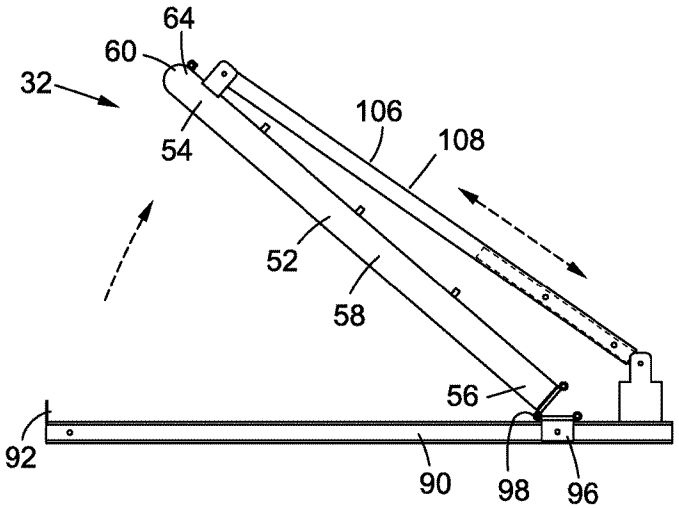
FIG. 10 is a side view of the sport goal of FIG. 6 (without the outline of the base housing)
Figure 9:
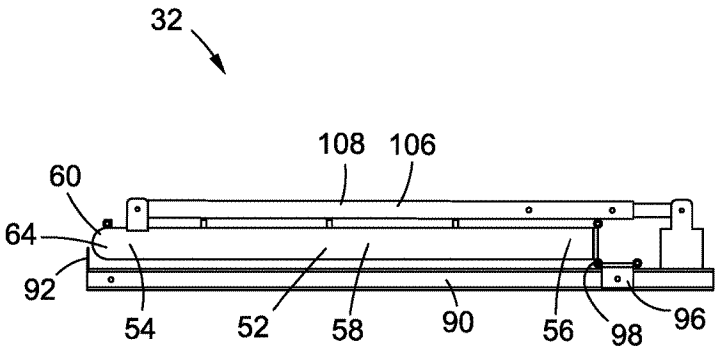
FIG. 9 is a side view of the sport goal of FIG. 5 (without the outline of the base housing)
Figure 12:
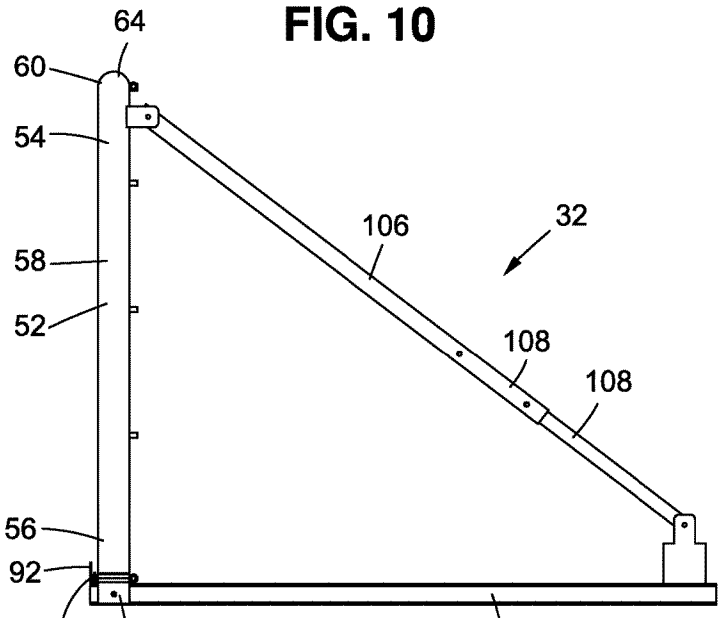
FIG. 12 is a side view of the sport goal of FIG. 8 (without the outline of the base housing)
Figure 11:
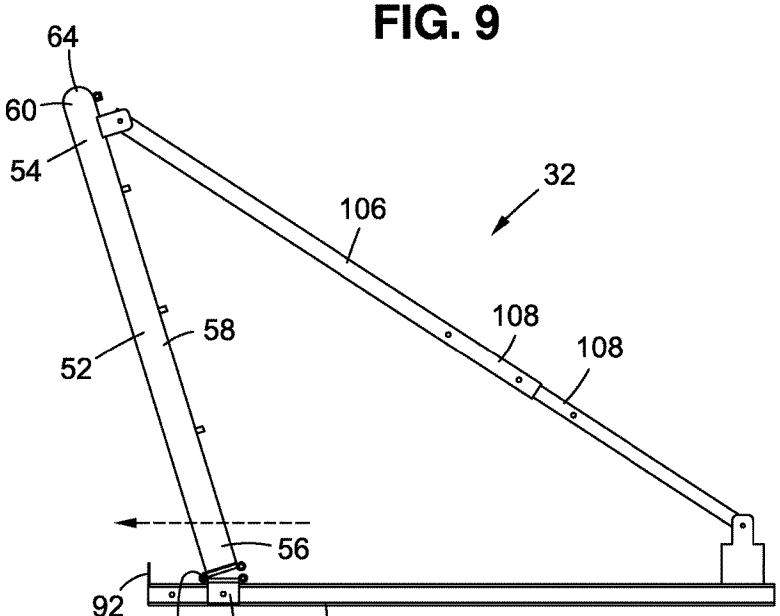
FIG. 11 is a side view of the sport goal of FIG. 7 (without the outline of the base housing)
Figure 13:
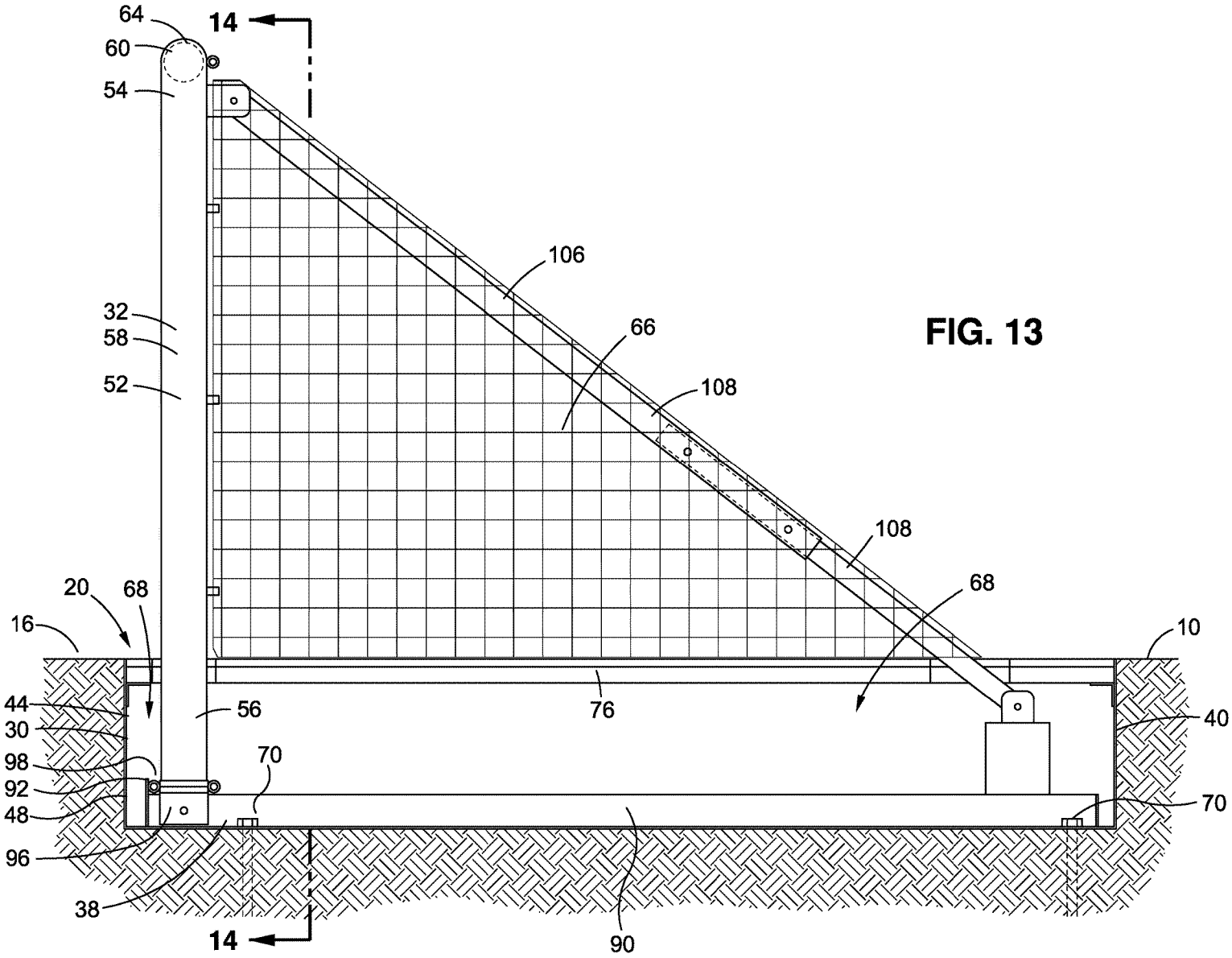
FIG. 13 is a side view of the sport goal of FIG. 8 with the base housing and attached net as installed in a playing surface.
Figure 14:
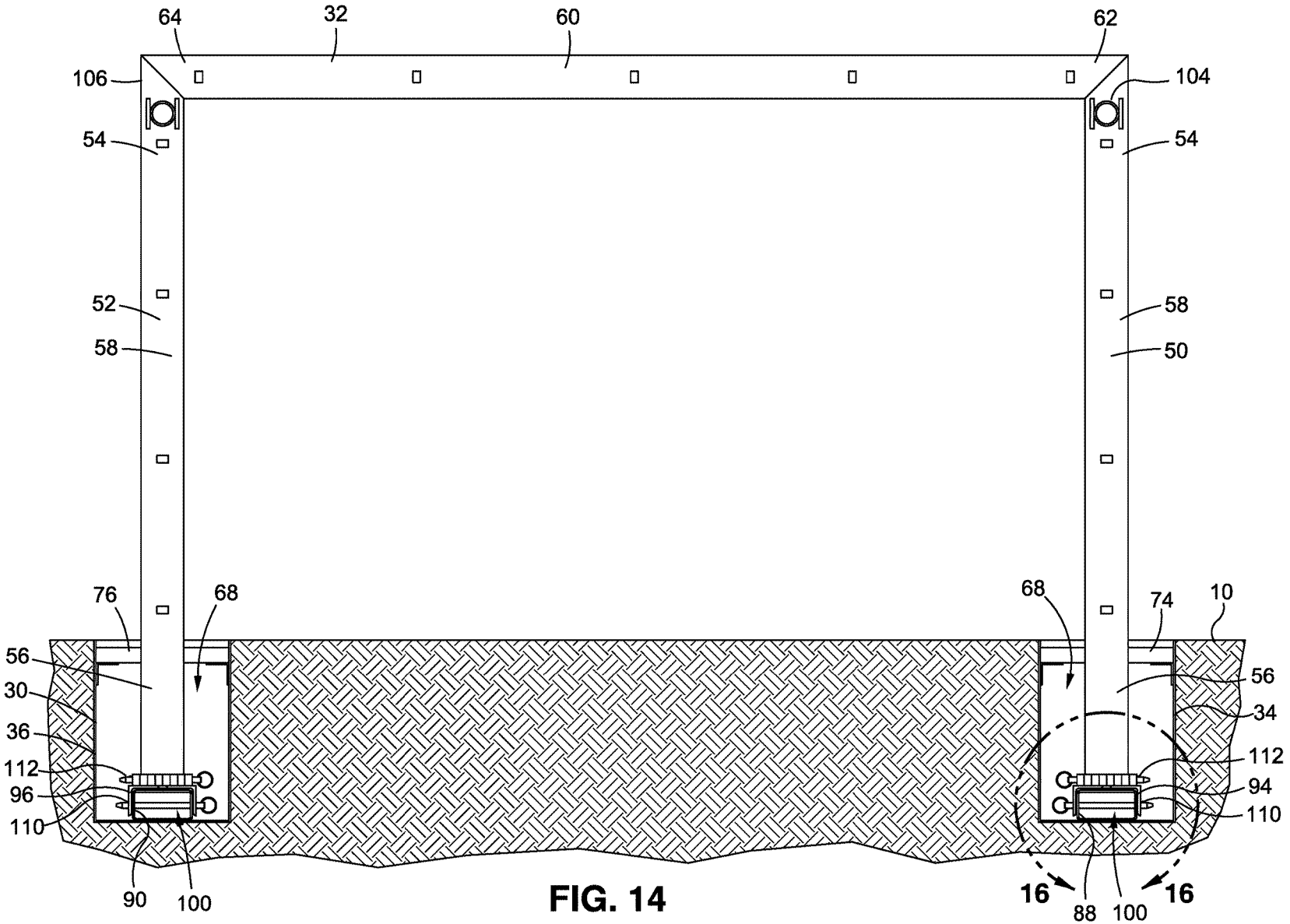
FIG. 14 is a cross-sectional back view of the sports goal of FIG. 13 as depicted along axis 14-14.
Figure 15:
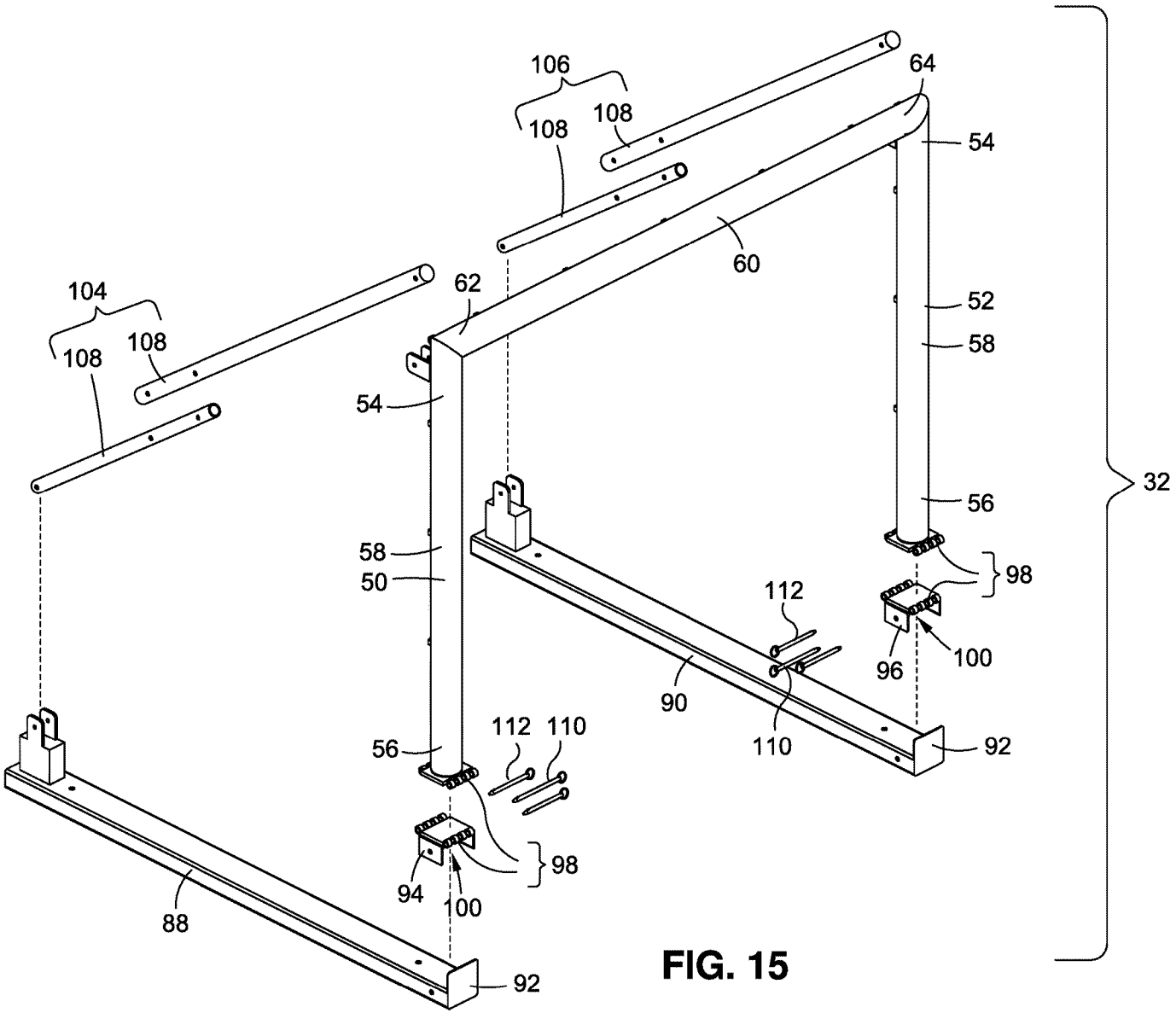
FIG. 15 is an exploded perspective view of the sports goal of FIG. 8.

According to various embodiments, the base housing 30 generally defines a rectangular U-shape as formed by the first and second post sections 34, 36 and the crossbar section 44, as best seen in the top views of FIGS. 2 and 3. A lateral cross-section of the first and second post sections 34, 36 is also U-shaped as best seen in the cross-sectional back view of FIG. 14. In this respect the base housing 30 defines a U-shaped channel 68 having a U-shaped cross section. The U-shaped channel 68 is sized and configured to receive the goal frame 32 therein. Upon installation, base housing 30 would be positioned within a similarly shaped trench formed in the playing surface 10. Anchor spikes or bolts 70 may be used to secure the base housing 30 in the playing surface 10.

The base housing 30 may further include a main cover plate 72 and first and second side plates 74, 76. The main cover plate 72 is positionable along the crossbar section 44 of the base housing 30. The main cover plate 72 and the crossbar section 44 are cooperatively sized and configured to surround the crossbar 60 with the goal frame 32 in the retracted position. The main cover plate 72 has a closed position with the main cover plate 72 positioned to cover the U-shaped channel 68, such as depicted in FIGS. 2 and 4. The main cover plate 72 may also have an opened position with the main cover plate 72 positioned to not cover the U-shaped channel 68. For example, referring now to FIG. 3, the main cover plate 72 is rotated from its closed position in a direction forward away from the base housing 10 and lying upon the playing surface 10. The main cover plate 72 may be attached to the crossbar section 44, such as through the use of hinges 78. Alternatively, the main cover plate 72 may be simply removed to expose the U-shaped channel 68 when deploying the goal frame 32 and replaced to cover the U-shaped channel 68 once the goal frame 32 is fully deployed in its playing position or when the goal frame 32 is in its retracted position for storage.

With the goal frame 32 in its playing position, the bottom ends 56 of the first and second goal posts 50, 52 are disposed vertically upward from the base housing 30 adjacent the opposing ends of the main cover plate 72. In this regard, with reference to FIG. 3, the main cover plate 72 may include first and second end flaps 80, 82 and a plate body 84 extending between the first and second end flaps 80, 82. The main cover plate 72 is disposable between the bottom ends 56 of the first and second goal posts 50, 52 with the goal frame 32 in the retracted position and the first and second end flaps 80, 82 being aligned with the plate body 84. The first and second end flaps 80, 82 and the plate body 84 may each be hingedly attached to the crossbar section 44 of the base housing 30. Upon deployment of the goal frame 32 from its retracted position to the playing position, the first and second end flaps 80, 82 may be rotated downward to hang vertically within the U-shaped channel 68. The plate body 84 may then be rotated to be horizontal and covering the U-shaped channel 68 and thereby placing the main cover plate 72 in its closed position. The plate body 84 of the main cover plate 72 is then disposable between the bottom ends of the first and second goal posts 50, 52 with the goal frame 32 in the playing position and the first and second end flaps 80, 82 being folded. It is contemplated that the first and second side plates 74, 76 may include various tabs that prevent the first and second end flaps 80, 82 from rotating into the U-shaped channel 68 when the first and second side plates 74, 76 are in their closed positions and the first and second end flaps 80, 82 are then respectively placed atop of them.

It is contemplated that the first and second end flaps 80, 82 may be configured differently. For example, though not shown, the first and second end flaps 80, 82 may be hingedly attached to opposing ends of the plate body 84 with the first and second end flaps 80, 82 hanging vertically or folded under the plate body 84 when the plate body 84 is in the closed position.

The first and second side plates 74, 76 are respectively positionable along the first and second post sections 34, 36 of the base housing 30. The first side plate 74 and the first post section 34 of the base housing 30 are cooperatively sized and configured to surround the first goal post 50 with the goal frame 32 in the retracted position. The second side plate 76 and the second post section 36 of the base housing 30 are cooperatively sized and configured to surround the second goal post 52 with the goal frame 32 in the retracted position. The first and second side plates 74, 76 each respectively have a closed position with the first and second side plates 74, 76 positioned to cover the U-shaped channel 68, such as depicted in FIGS. 2 and 4. The first and second side plates may 74, 76 each also have an opened position with the first and second side plates 74, 76 respectively positioned to not cover the U-shaped channel 68. For example, referring now to FIG. 3, the first and second side plates 74, 76 are respectively rotated toward each other from their closed positions and lying upon the playing surface 10. The first and second side plates may be respectively attached to the first and second post sections 34, 36, such as through the use of hinges 86. Alternatively, the first and second side plates 74, 76 may be simply removed to expose the U-shaped channel 68 when deploying the goal frame 32 and replaced to cover the U-shaped channel 68 once the goal frame 32 is fully deployed in its playing position or when the goal frame 32 is in its retracted position for storage. In another configuration not shown, rather than having the first and second end flaps 80, 82, the main cover plate 72 may extend across the crossbar section 44 and the first and second side plates 74, 76 may have their own flaps to accommodate the first and second goal posts 50, 52 when the first and second side plates 74, 76 are in their respective closed positions.

The main cover plate 72 and the first and second side plates 74, 76 are configured to seamlessly blend with the adjacent playing surface 10 so as minimize any trip hazard and to mitigate against water from entering the base housing 30. In this regard, the main cover plate 72 and the first and second side plates 74, 76 are configured to be vertically aligned with the playing surface 10 and with a minimal amount of gaps with the playing surface when in their closed positions. The hinges 78 may be recessed to as to not protrude from the playing surface 10. Further, the outer surfaces of the main cover plate 72 and the first and second side plates 74, 76 may be include surface characteristics to be similar to the surrounding playing surface 10 and/or to not be relatively smooth so as to create in slip hazard.

Various warning indicia may be imprinted upon the main cover plate 72 when rotated to this opened position so as to warn user not to "play." Such warning indicia would not be visible when the main cover plate 72 and the first and second side plates 74, 76 are in their closed positions.

The sports goal 12 may further include first and second rails 88, 90 respectively disposed in the first and second post sections 34, 36. The first and second rails 88, 90 may be secured to the base housing 30 at the bottom U-shaped channel 68. The first and second rails 88, 90 are respectively in contact with the first and second goal posts 50, 52 during movement of the goal frame 12 between the retracted position and the playing position. In this regard, the bottom ends 56 of the first and second goal posts 50, 52 are respectively configured to translate along and be supported by the first and second rails 88, 90 and the corresponding first and second post sections 34, 36. The first and second rails 88, 90 may each have an end stop 92 distally attached there to prevent the bottom ends 56 from moving forward beyond such location.

The sports goal 12 may further include first and second U-shaped support members 94, 96 respectively attached to the bottom ends 56 of the first and second goal posts 50, 52. The U-shaped support members 94, 96 may each be respectively hingedly attached to the bottom ends 56 with hinges 98. The hinges 98 are disposed towards the cross bar section 44 with the goal frame 32 in the playing position. The hinges 98 allow the U-shaped support members 94, 96 to lay relatively flat along the first and second rails 88, 90 when the goal frame 32.

Each of the first and second U-shaped support members 88, 90 have a cavity 100 sized and configured to respectively receive the first and second rails 88, 90 therein. As seen in the enlarged view of FIG. 16, a slide insert 102 may be positioned in each cavity 100. Each slide insert 102 is intended to respectively slide along the first and second rails. Each slide insert 102 may be formed of a durable plastic material. In this regard, the bottom ends 56 of the goal frame 32 may be disposed in sliding contact with the first and second rails 88, 90.

The sports goal may further include first and second support bars 104, 106. The first support bar may be attached to the first goal post and the first post section, and the second support bar may be attached to the second goal post and the second post section. In the embodiment depicted, the first and second support bars are attached to the first and second post sections adjacent the back ends 40 by being respectively directly attached to the first and second rails. The first and second support bars are pivotably connected to the first and second rails, such as through the use of pin connectors. The first and second support bars are also respectively connected to the goal frame adjacent the first and second crossbar ends 62, 64. The first and second support bars may also be pivotably connected to the top ends 54 of the first and second goal posts 50, 52 adjacent the first and second crossbar ends 62, 64, such as through the use of pin connectors.

The first and second support bars 104, 106 have a stored length and an extended length. The first and second support bars 104, 106 respectively have the stored length upon the goal frame being disposed in the retracted position. The first and second support bars 104, 106 respectively have the extended length upon the goal frame 32 being disposed in the playing position. The first and second support bars 104, 106 are contemplated to have vary in length as the goal frame 32 is moved between its retracted and playing positions, such as depicted in the intermediate positions in FIGS. 6, 7, 10 and 11. The first and second support bars 104, 106 may be formed of telescoping sections 108. The first and second support bars 104, 106 are respectively selectively lockable in the extended length upon the goal frame 32 being disposed in the playing position. Such selective locking may include spring loaded push-pins to joint adjacent telescoping sections 108 for example.

Once the goal frame 32 is in its playing position, the goal frame 32 may be temporarily locked into place. This is provided as a safety feature to mitigate against the goal frame 32 from inadvertently collapsing from the playing position. The U-shaped support members 94, 96 have may each have a hole that is respectively aligned with hole in the first and second rails 88, 90 through which cotter pins 110 may be inserted. Matching pin supports may also be provided at the bottom ends 56 of the first and second goal posts 50, 52 and each of the U-shaped support members 94, 96 that cooperatively receive cotter pins 112 to lock each of the U-shaped support members 94, 96 relative to each respective post body 58. It is contemplated that other locking configurations may be implemented which are well known to one of ordinary skill in the art, such as sliding locking bars that are attached to each of the first and second goal posts 50, 52 that are vertically inserted into the first and second rails 88, 90.

Figure 17:
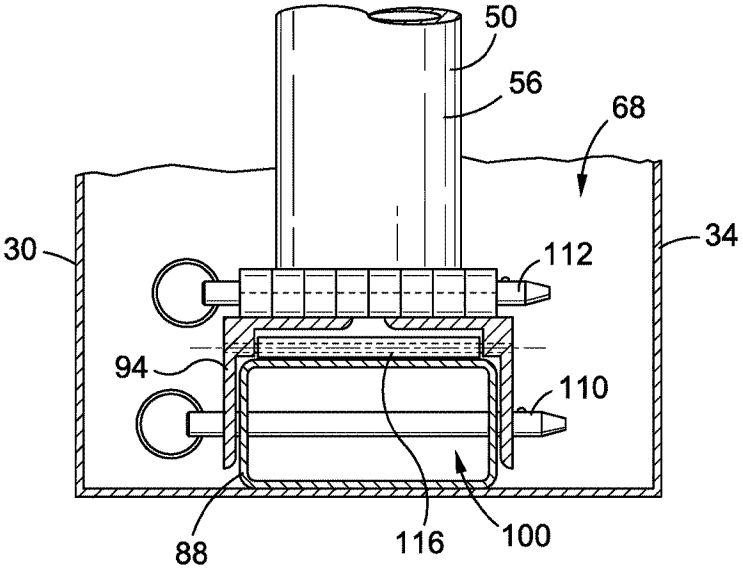
FIG. 17 is a cross-sectional back view of a portion of the sports goal similar to FIG. 16 according to another embodiment.
Figure 16:
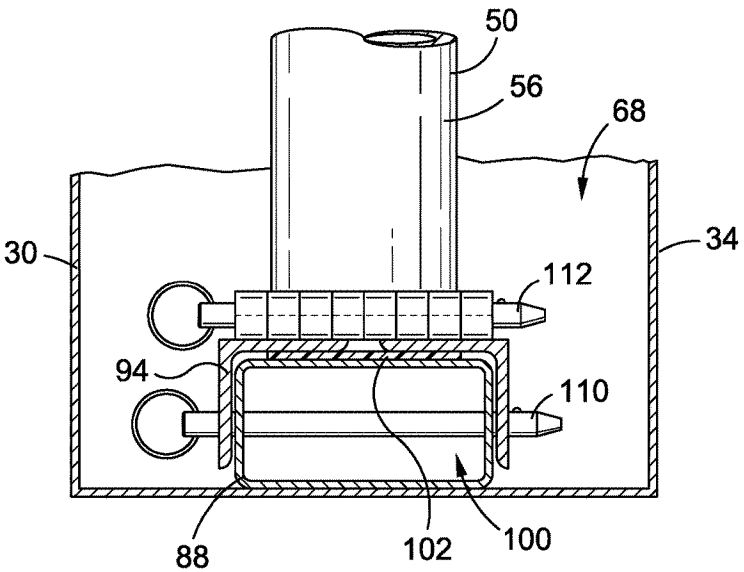
FIG. 16 is an enlarged cross-sectional back view of a portion of the sports goal as indicated in FIG. 14.

Referring now to FIG. 17 there is depicted is a cross-sectional back view of a portion of the sports goal 12 similar to FIG. 16 according to another embodiment. Like reference numerals indicate like structures. Thus, similar referenced structures are as described above but with those differences noted. In this embodiment, there is provided a U-shaped support member 114. Unlike the U-shaped support member 94 described above, the U-shaped support member 114 is not disposed in sliding contact with the associated first rail 88 and does not include a slide insert 102. Rather, the U-shaped support member 114 includes one or more rollers 116 attached thereto in the cavity 100 of the U-shaped support member 114 for engaging the first rail 88 in rolling contact during movement of the goal frame 32 between a retracted position and a playing position. A similarly configured U-shaped support member 114 and roller 116 may be associated with the second goal post 52.

Figure 18:
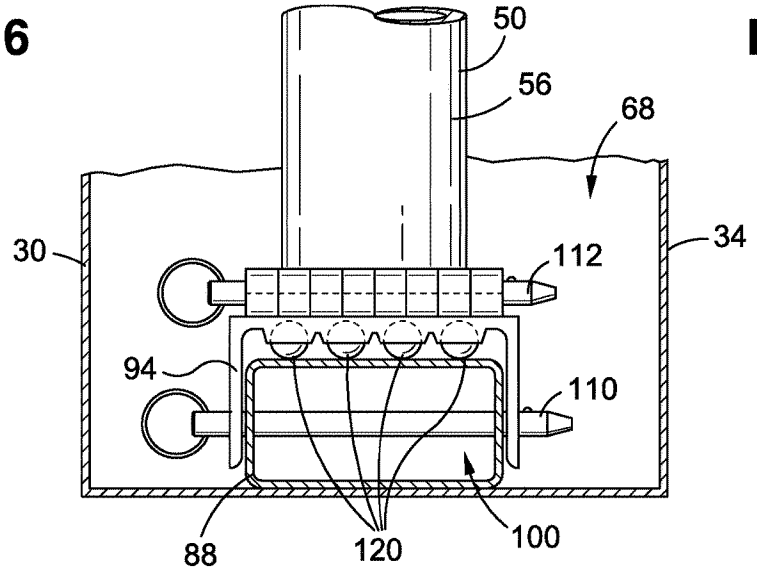
FIG. 18 is a cross-sectional back view of a portion of the sports goal similar to FIG. 16 according to another embodiment.

Referring now to FIG. 18 there is depicted is a cross-sectional back view of a portion of the sports goal 12 similar to FIG. 16 according to another embodiment. In this embodiment, there is provided a U-shaped support member 118. Unlike the U-shaped support member 94 described above, the U-shaped support member 118 is not disposed in sliding contact with the associated first rail 88 and does not include a slide insert 102. Rather, the U-shaped support member 118 includes a plurality of ball bearings 120 attached thereto in the cavity 100 of the U-shaped support member 118 for engaging the first rail 88 in rolling contact during movement of the goal frame 32 between a retracted position and a playing position. A similarly configured U-shaped support member 118 and ball bearings 120 may be associated with the second goal post 52.

It is contemplated that various other arrangements may be provided according to those which are well known to one of ordinary skill in the art that facilitate translational movement of the bottom ends 56 of the first and second goal posts 50, 52 along the respective first and second post sections 34, 36 (including along the first and second rails 88, 90 in those embodiments that include the first and second rails 88, 90). For example various grooves and tracks may be used.

It is further contemplated that the material selections for the various components of the retractable sport goal 12 and the related manufacturing processes thereof may be chosen from any of those which are well known to one of ordinary skill in the art. For example the base housing 30, the goal frame 32, the first and second rails 88, 90 and the first and second U-shaped support members 94, 96 may all be formed of metal, such as steel tubing and plates, of a variety of types and thicknesses with a variety of surface treatments.

According to another aspect of the present invention, there is provided a method of installing the sports goal 12 for use in the playing surface 10 having the basketball court 16 with the pole 24 installed in the playing surface 10. The pole 24 supports the basketball backboard 26 and the basketball hoop 28 extends from the backboard 26 towards the basketball court 16. The method begins with providing a sports goal 12 such as described above. The method further includes positioning the base housing 30 in the playing surface 10 with the crossbar section 44 being parallel to the backboard 26 along the basketball court 16. In particular a crossbar section 44 may be positioned along the first baseline 20. In this regard, a trench may be formed in the playing surface 10 adjacent the first baseline 20 of the basketball court 16. The trench would be generally U-shaped so as to receive the base housing 30 therein. It is contemplated that the base housing 30 may include various drainage holes at the bottom of the U-shaped channel 68 to allow for drainage into the trench. The bottom the trench may be lined with gravel or other drainage arrangement.

According to various embodiments, the method may further include positioning the cross bar section 44 between the pole 24 and the basketball court 16. The positioning of the base housing 30 in the playing surface 10 may include positioning the back ends 40 of the base housing 30 with the pole 24 disposed between the back ends 40 and the basketball court 16. The positioning of the base housing 30 in the playing surface 10 may include positioning the first and second post sections 34, 36 with the pole 24 disposed there between. The base housing 30 may be positioned such that it does not extend above the playing surface 10. The method may further includes providing the main cover plate 72 positionable along the crossbar section 44 of the base housing 30 with the main cover plate 72 and the crossbar section 44 being cooperatively sized and configured to surround the crossbar 80 with the goal frame 32 in the retracted position. The method may further include aligning the main cover plate 72 with the playing surface 10 with the main cover plate 72 positioned along the crossbar section 44 and the main cover plate 72 and the crossbar section 44 surrounding the crossbar with the goal frame 32 in the retracted position. The method may further include attaching the net 66 to the goal frame 32.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A retractable sports goal comprising:

a horizontally disposed base housing including:

first and second post sections, each of the first and second post sections having a front end, a back end and a post section body disposed between the front and back ends; and a crossbar section having first and second ends, the first and second ends being respectively connected to the front ends of the first and second post sections with the crossbar section being disposed perpendicular to the first and second post sections; and a goal frame including:

first and second goal posts, each of the first and second goal posts having a top end, a bottom end and a post body disposed between the top and bottom ends; and a crossbar having first and second crossbar ends, the first and second crossbar ends being respectively connected to the top ends of the first and second goal posts with the crossbar being disposed perpendicular to the first and second goal posts; and wherein the bottom ends of the first and second goal posts being respectively in contact with the first and second post sections during movement of the goal frame between a retracted position and a playing position, in the retracted position the goal frame is disposed in the base housing with the first and second goal posts and the crossbar respectively disposed adjacent the first and second post sections and the crossbar section, in the playing position the goal frame is disposed vertically with the bottom ends of the first and second goal posts respectively disposed adjacent the front ends of the first and second post sections; and wherein the base housing further including:

a main cover plate positionable along the crossbar section, the main cover plate and the crossbar section being cooperatively sized and configured to surround the crossbar with the goal frame in the retracted position, the main cover plate being hingedly attached to the crossbar section, the main cover plate including first and second end flaps and a plate body extending between the first and second end flaps, the main cover plate being disposable between the bottom ends of the first and second goal posts with the goal frame in the playing position and the first and second end flaps being folded, the main cover plate being disposable between the bottom ends of the first and second goal posts with the goal frame in the retracted position and the first and second end flaps being aligned with the plate body.

2. The sports goal of claim 1 further includes first and second support bars, the first support bar is attached to the first goal post and the first post section, the second support bar is attached to the second goal post and the second post section.

3. The sports goal of claim 2 wherein the first and second support bars have a stored length and an extended length, the first and second support bars respectively have the stored length upon the goal frame being disposed in the retracted position, the first and second support bars respectively have the extended length upon the goal frame being disposed in the playing position.

4. The sports goal of claim 3 wherein the first and second support bars are respectively selectively lockable in the extended length upon the goal frame being disposed in the playing position.

5. The sports goal of claim 3 wherein the first and second support bars are formed of telescoping sections.

6. The sports goal of claim 1 further includes first and second rails respectively disposed in the first and second goal post sections and respectively in contact with the first and second goal posts during movement of the goal frame between a retracted position and a playing position.

7. The sports goal of claim 6 further includes first and second U-shaped support members respectively attached to the bottom ends, each of the first and second U-shaped support members have a cavity sized and configured to respectively receive the first and second rails therein.

8. The sports goal of claim 7 wherein the first and second U-shaped support member respectively include rollers attached therein in the cavity of each of the U-shaped support members for engaging the first and second rails in rolling contact during movement of the goal frame between a retracted position and a playing position.

9. The sports goal of claim 1 further includes a net attachable to the goal frame.

10. A retractable sports goal comprising: a horizontally disposed base housing including: first and second post sections, each of the first and second post sections having a front end, a back end and a post section body disposed between the front and back ends; and a crossbar section having first and second ends, the first and second ends being respectively connected to the front ends of the first and second post sections with the crossbar section being disposed perpendicular to the first and second post sections; and a goal frame including: first and second goal posts, each of the first and second goal posts having a top end, a bottom end and a post body disposed between the top and bottom ends, the bottom ends of the first and second goal posts being respectively in contact with the first and second post sections during movement of the goal frame between a retracted position and a playing position; a crossbar having first and second crossbar ends, the first and second crossbar ends being respectively connected to the top ends of the first and second goal posts with the crossbar being disposed perpendicular to the first and second goal posts, in the retracted position the goal frame being disposed in the base housing with the first and second goal posts and the crossbar respectively disposed adjacent the first and second post sections and the crossbar section, in the playing position the goal frame being disposed vertically with the bottom ends of the first and second goal posts respectively disposed adjacent the front ends of the first and second post sections; first and second rails respectively disposed in the first and second post sections and respectively in contact with the first and second goal posts during movement of the goal frame between a retracted position and a playing position; and first and second U-shaped support members respectively attached to the bottom ends, each of the first and second U-shaped support members having a cavity sized and configured to respectively receive the first and second rails therein, the first and second U-shaped support member respectively including rollers attached therein in the cavity of each of the U-shaped support members for engaging the first and second rails in rolling contact during movement of the goal frame between a retracted position and a playing position.

* * * * *